US012747119B2

(12) United States Patent
Schrems et al.

(10) Patent No.: US 12,747,119 B2
(45) Date of Patent: Sep. 29, 2026

(54) PACKAGING DEVICE FOR PRODUCING PACKAGING UNITS, REMOVAL DEVICE AND METHOD FOR REMOVING AND SEPARATING MAGAZINED PACKAGING BLANKS, AND USE THEREOF IN THE PRODUCTION OF PACKAGING UNITS

(71) Applicant: Krones Aktiengesellschaft, Neutraubling (DE)

(72) Inventors: Rudolf Schrems, Aschau (DE); Veronika Kunsler, Rimsting (DE); Thomas Stadler, Kolbermoor (DE); Wolfgang Fechter, Rosenheim (DE); Philipp Schartner, Feldkirchen-Westerham (DE); Markus Prinz, Tuntenhausen (DE)

(73) Assignee: Krones Aktiengesellschaft, Neutraubling (DE)

( * ) Notice: Subject to any disclaimer, the term of this patent is extended or adjusted under 35 U.S.C. 154(b) by 0 days.

(21) Appl. No.: 19/105,553

(22) PCT Filed: May 8, 2023

(86) PCT No.: PCT/EP2023/062117
§ 371 (c)(1),
(2) Date: Feb. 21, 2025

(87) PCT Pub. No.: WO2024/041765
PCT Pub. Date: Feb. 29, 2024

(65) Prior Publication Data

US 2026/0138771 A1 May 21, 2026

(30) Foreign Application Priority Data

Aug. 24, 2022 (DE) ..... 10 2022 121 370.6

(51) Int. Cl.
*B65H 3/08* (2006.01)
*B65B 17/02* (2006.01)
(Continued)

(52) U.S. Cl.
CPC ..... *B65H 3/0833* (2013.01); *B65B 17/025* (2013.01); *B65B 43/165* (2013.01);
(Continued)

(58) Field of Classification Search
CPC .. B65H 3/0808; B65H 3/0816; B65H 3/0833; B65H 3/0841; B65H 3/0883; B65H 3/34; B65H 3/54; B65B 43/185; B65B 3/18
See application file for complete search history.

(56) References Cited

U.S. PATENT DOCUMENTS 3,826,485 A 7/1974 Shindo
5,263,699 A 11/1993 Selak et al.
(Continued)

FOREIGN PATENT DOCUMENTS

DE 102008040825 A1 2/2010
DE 102008040826 A1 2/2010
(Continued)

OTHER PUBLICATIONS

PCT Application: PCT/EP2023/062117 filed May 8, 2023—International Preliminary Report on Patentability dated Mar. 6, 2025.
(Continued)

*Primary Examiner* — Jeremy R Severson
(74) *Attorney, Agent, or Firm* — Simmons Perrine PLC

(57) ABSTRACT

A packaging apparatus includes a magazine (12) having several stacked, sheet-like packaging blanks (10), and a removal apparatus. The removal apparatus includes a horizontally and vertically movable handling device (16) with tools. The tools include at least a clamping bracket (22) and
(Continued)

a gripping device (30). The clamping bracket (22) serves presses on and fixes the stack (14) of packaging blanks (10) in a first surface region (24). The gripping device (30) takes hold of a packaging blank (10, 10-1) that is uppermost in the stack (14), in a second surface region (32). The gripping device (30) is pivotable such that the second surface region (32) can be angled towards the first surface region (24) to separate the gripped packaging blank (10, 10-1) from the stack (14), after releasing the clamping bracket (22), and to remove it from the magazine (12).

10 Claims, 5 Drawing Sheets

(51) Int. Cl.
*B65B 43/16* (2006.01)
*B65B 43/18* (2006.01)
*B65H 3/54* (2006.01)

(52) U.S. Cl.
CPC ..... *B65B 43/185* (2013.01); *B65H 3/0841* (2013.01); *B65H 3/0883* (2013.01); *B65H 3/54* (2013.01); *B65H 2301/4237* (2013.01); *B65H 2301/5121* (2013.01); *B65H 2402/31* (2013.01); *B65H 2801/81* (2013.01)

(56) References Cited

U.S. PATENT DOCUMENTS

| | | | | |
|---|---|---|---|---|
| 5,989,386 | A * | 11/1999 | Elliott | B65H 3/0816 156/707 |
| 6,675,712 | B2 * | 1/2004 | Marincic | B65H 3/0883 271/106 |
| 7,364,616 | B2 * | 4/2008 | Tsuchiya | B65H 3/0816 117/2 |
| 11,345,499 | B2 | 5/2022 | Canalicchio et al. | |
| 2013/0108408 | A1 | 5/2013 | Saison et al. | |

FOREIGN PATENT DOCUMENTS

| | | | |
|---|---|---|---|
| DE | 102017103829 | A1 | 8/2018 |
| EP | 1075419 | A1 | 2/2001 |
| JP | 2000103411 | A | 4/2000 |

OTHER PUBLICATIONS

PCT Application: PCT/EP2023/062117 Filed May 8, 2023—International Search Report dated Aug. 10, 2023.
Priority Application: DE 10 2022 121 370.6—Filed Aug. 24, 2022—German Search Report dated May 2, 2023.

* cited by examiner

PACKAGING DEVICE FOR PRODUCING PACKAGING UNITS, REMOVAL DEVICE AND METHOD FOR REMOVING AND SEPARATING MAGAZINED PACKAGING BLANKS, AND USE THEREOF IN THE PRODUCTION OF PACKAGING UNITS

CLAIM OF PRIORITY

The present application claims priority to International Application PCT/EP 2023/062117, dated May 8, 2023, which in turn claims priority to German Application DE 10 2022 121 370.6, dated Aug. 24, 2022, which are incorporated by reference.

FIELD OF THE INVENTION

The present invention relates to a packaging apparatus, to a removal apparatus usable in the packaging apparatus, and to a method for producing packaging units. The invention also relates to a method for separating magazined packaging blanks, in particular for the purpose of their use in the production of packaging units.

BACKGROUND OF THE INVENTION

In practice, numerous different types of packaging are used for the processing, assembly, grouping and packaging of articles or piece goods such as beverage containers. A frequently used variant consists, for example, of grouping and mechanically combining several identical articles or containers into portable, relatively handy bundle units or packaging units. Here, too, various options are known for combining individual articles or containers into larger packs. For example, beverage containers are often combined and packaged using shrink films to form bundles of four, six or more beverage containers. The production of packs is usually essential because they are the most common variant of packaging units for beverage containers or bottles made of PET plastics. In some cases, the containers are combined again for transport and/or assembled and palletized in layers.

Specific fabrication steps are required in connection with the production of known bundle variants in order to be able to process the shrink films normally used for the bundles. Such fabrication steps require a relatively high energy input, not least because of the shrinking process of the film that takes place under the effect of heat. In addition, the film used incurs costs for production, provision, handling as well as later disposal, since it is no longer required after sale to the end customer and the unpacking of the articles or containers. The machine configuration for providing the so-called film wrapping modules and other handling stations necessary for the film packaging also incurs high investment costs. Finally, a relatively high investment of capital is also needed for the provision of the so-called shrink tunnel, with which the film wrapped around the bundle is shrunk around the containers by hot air application.

A variant in which the use of shrink films can basically be dispensed with are so-called strapping bundles. In this case, the containers are connected to one another by so-called strapping bands and combined into a bundle. In continuous or cyclically operating strapping machines, containers, articles or bottles are grouped into formations and are then strapped with one or more bands using strapping assemblies, normally by strapping bands stretched horizontally around the articles or containers held together. Typical formations can be, for example, 1×2 arrangements (two containers in a row), 2×2 arrangements (four containers in a square or diamond formation), 3×2, 4×3 or in principle also variable n×m arrangements.

In addition to simple cardboard packaging, which can be supplemented by so-called compartments for separating and determining the container positions within the cardboard packaging, other packaging variants have proven to be suitable for practical use. These include so-called gripping carton packages or upper gripping carton packages, used to group several bottles together via their neck regions. A packaging machine for placing such upper gripping cardboard packages is described in patent specification EP 1 075 419 B1. In this document, the articles or containers are arranged in a crate, and the gripping cardboard package is placed on the at least one article arranged in the crate from above. In particular, a plurality of articles are arranged in the crate, and by placing a smaller number of upper gripping cardboard packages on top, subgroups are formed, each of which combines some of the articles arranged in the crate.

In a gripping cardboard package, the arrangement and number of through-openings corresponds to the arrangement and number of articles or containers to be combined. The diameter of the through-openings is usually slightly smaller than the maximum diameter of the articles in an upper region. The gripping cardboard package is placed on the articles and pressed thereon so that a defined upper region of the articles is pushed through the through-openings. In particular, an upper region with a maximum diameter is pushed through the through-openings, and the edge regions of the through-openings are brought into engagement with the articles below this maximum diameter so that the gripping cardboard package is securely and firmly fixed to the articles. In order to fix the gripping cardboard package to the articles in this way, in particular to push the articles through the through-openings, relatively high application forces are necessary. Accordingly, the articles must offer adequate resistance to this application force so that the articles are not damaged when the gripping cardboard package is attached.

In addition, it should be noted that such gripping carton packages are also suitable for the combining and packaging of beverage cans if the dimensions of the openings as well as their positioning and spacing from one another are adjusted to the can sizes.

In the case of an automated application of the gripping cardboard packages on the previously grouped articles or beverage containers, application devices provided for this purpose and equipped accordingly are usually used, such as specially adjusted gripping robots, wherein the gripping cardboard packages are removed one after the other from magazines in which a large number of flat gripping cardboard packages are stacked and made available for removal by the application device.

A handling device for removing flat blanks stacked in magazines, which are folded and inserted into cardboard packages as compartments for dividing and separating beverage containers to be inserted therein, is disclosed in DE 10 2017 103 829 A1. To remove and separate the blanks stacked in the magazine, a handling element is used which has suitable suction devices to grasp each individual blank and remove them one after the other from the magazine in order to then supply them for further use in the packaging process.

An apparatus and a method for removing stacked cardboard blanks from a magazine is also known from DE 10 2018 132 330 A1. The removal apparatus, which can be moved horizontally and vertically, comprises suction tools for taking hold of individual cardboard blanks from the magazine. In order to carry out a compensating movement and to align the cardboard blanks in a horizontal plane, the suction tool or the suction tools are arranged so as to be pivotable about a further axis inside or on the removal apparatus. Since the cardboard blanks in the magazine can be stacked at a greater or lesser inclination, the additional axis is provided in order to compensate for such an inclination.

The use of suction tools is therefore a common measure when using removal apparatuses that are used to remove and separate flat cardboard blanks stacked in magazines. However, various effects can hinder the vacuum-controlled separation of magazined cardboard blanks and, depending on the severity of the effects, lead to undesirable malfunctions. Since cardboard blanks lying against another over a large surface can lead to the adjoining blanks being pulled along when an uppermost blank is lifted off due to the adhesion forces between the adjoining blanks, suitable measures must be taken to suppress or prevent such pulling effects.

In the case of air-permeable cardboard blanks or those with previously made openings, punchings, perforations, etc., lifting using negative pressure suction cups can fail or lead to malfunctions in that, due to the air permeability, several adjoining cardboard blanks are simultaneously suctioned up and pulled off the magazine stack instead of the uppermost cardboard blank. To prevent this, the negative pressure for suctioning the uppermost cardboard blank can be reduced if necessary, but in the case of larger cardboard blanks this can lead to a reduction in the load-bearing capacity of the handling element, so that this load-bearing capacity may no longer be sufficient to lift the cardboard blank and/or to handle it safely.

In view of the disadvantages identified in the prior art, it can be considered the primary object of the invention to reduce or eliminate these various disadvantages by creating an improved and more reliable possibility for receiving magazined packaging blanks that allows blanks of all types to be picked up and separated, including those with air-permeable regions.

This object is achieved with a packaging apparatus and with a method for producing packaging units which have the features of the independent claims. Features of advantageous embodiments are found in the dependent claims.

SUMMARY OF THE INVENTION

To achieve the above-mentioned object, the present invention proposes a packaging apparatus having the features of the corresponding independent claim. This packaging apparatus according to the invention serves in particular for combining several articles by an outer packaging formed from a packaging blank, as has already been explained in its basic features above, for example for combining a defined number of beverage cans by a packaging blank made of cardboard, in the recesses of which the beverage cans are latched and thus combined to form a packaging unit.

The packaging apparatus according to the invention comprises at least one magazine with several flat packaging blanks stacked therein, wherein the packaging blanks are stacked on top of one another in the magazine or, in the case of inclined or upright stacking, are arranged with their flat sides joined together. The packaging apparatus is equipped with a removal apparatus for the individual removal of packaging blanks from the magazine. This removal apparatus in turn has a horizontally and vertically movable handling device with tools arranged thereon for handling the packaging blanks and for removing them individually from the magazine.

Thus, the handling tools of the handling device, which is part of the removal apparatus, are formed at least by a clamping bracket and by a gripping device. The clamping bracket is used to press on and fix the stack of packaging blanks located in the magazine in a first surface region and is configured accordingly for this purpose.

The gripping device serves to take hold of a packaging blank located uppermost on the stack or at the edge of the stack in a second surface region adjoining the first surface region and is configured accordingly for this purpose. The surface regions of the packaging blanks refer to regions of the packaging blank that can be delimited from one another and which are not visually or otherwise delimited from one another or marked separately, but which refer to different regions on which the clamping bracket or gripping device acts. Each of these two surface regions can take up approximately half of a flat side of the corresponding packaging blanks, so that the clamping bracket can lie in the first surface region, i.e., in a first half of the flat side of the uppermost packaging blank, and can be pressed on there, while the gripping device can grasp the packaging blank in the second surface region, i.e., in the region of the flat side not pressed on by the clamping bracket, and lift it there.

In addition, the gripping device is pivotable during lifting or after lifting of the uppermost gripped packaging blank in the second surface region from the stack in such a way that the second surface region can be angled towards the first surface region fixed by the clamping bracket in order to separate the gripped packaging blank from the stack after releasing or lifting the clamping bracket and to remove it from the magazine by lifting the handling device.

Since the packaging blanks to be handled with the packaging apparatus described here may in particular have perforations or be air-permeable, they cannot be reliably lifted or separated using vacuum suction cups. Likewise, the packaging blanks may have a structured surface, which can make lifting and separating them using conventional vacuum suction cups problematic.

In the magazine, the packaging blanks are stacked flat against one another and may adhere to one another by adhesion when a packaging blank located at the edge or on the top is to be removed. By fixing a portion of the packaging blanks and simultaneously lifting the unfixed region of the uppermost packaging blank and then deforming this lifted portion, inherent stress can be generated and utilized in the packaging blanks situated underneath. The packaging blanks underneath are indeed also lifted in the non-fixed regions and also suctioned along, but the inherent stress generated due to the deformation allows the lower layers to reliably peel off despite the suction pressure, which ultimately leads to the reliable separation of the suctioned packaging blanks after the clamping bracket is removed.

In the manner described, even very thin and air-permeable packaging blanks made of cardboard or paper material can be reliably separated and removed from a magazine with vertical stacking on top of one another. The same applies to structured packaging blanks, where suction with conventional suction grippers presents certain difficulties, but this can be compensated for by an increased negative pressure, which may, however, make the countermeasures described necessary in order to prevent more than one individual packaging blank from being suctioned and picked up by the handling device.

In a variant of the packaging apparatus according to the invention, the clamping bracket arranged on the handling device can be placed and/or pressed against the magazine and onto the first surface region of the packaging blank situated at the edge of or uppermost on the stack by an infeed movement of the handling device, in order to in this way press the entire stack into the magazine and fix it there.

Optionally, in the packaging apparatus the handling device can have a gantry suspension or another suitable movable suspension and can thus be lifted and lowered and/or fed towards the stack and lifted away from it. Such a gantry suspension allows the handling device to be moved about three axes that are perpendicular to one another or possibly oriented at an angle to one another, and thus allows all necessary removal, conveying and transfer movements that are required for the separation, removal and transfer of the packaging blanks to downstream processing stations.

The gripping device arranged on the handling device is preferably prepared and equipped for taking hold of and gripping the packaging blank situated at the edge of or uppermost on the stack, wherein the gripping device can be arranged and mounted in particular pivotably on the handling device in order to be able to carry out the desired deformation movements of the packaging blanks in the manner described.

The gripping device can in particular comprise at least one suction plunger or at least one other gripper operating with suction pressure, wherein it can be useful if the suction plunger(s) can be subjected to a variably adjustable negative pressure in order to thus be able to adjust to the gripping forces required in each instance for the reliable gripping of the uppermost packaging blank.

As already explained above, in preferred variants of the packaging apparatus configured according to the invention it is expedient to configure the gripping device with the at least one suction plunger to be angle-adjustably or otherwise movably mounted relative to the clamping apparatus or the clamping bracket in order to thus be able to carry out the required deformation movements of the packaging blanks in each instance, which can ensure reliable peeling off of the other packaging blanks in the magazine below the uppermost packaging blank which is currently being suctioned and picked up.

To achieve the above-mentioned object, the present invention further proposes a method for removing individual flat packaging blanks from a magazine with several stacked packaging blanks having the features of the independent method claim. In this method according to the invention, in a multi-phase process a packaging blank situated at the edge of a stack or uppermost on the stack is first fixed in a first surface region and pressed into the magazine and then gripped in a second surface region adjoining the first surface region, after which the gripped packaging blank is lifted from the stack in the second surface region and angled and/or lifted towards the fixed first surface region.

The process of separating an uppermost or edge packaging blank when it is removed from the magazine is substantially characterized in that the packaging blank is deformed in partial regions compared to its previous position or orientation and in the process is angled relative to the other packaging blanks. However, this does not exclude the superposition of other movement components, which on the one hand may consist of an approximately vertical lifting off of the other packaging blanks in the magazine. It makes sense that these movement components of deformation and lifting are superimposed in such a way that the slight lifting is only made possible by the deformation.

Alternatively or additionally, a further movement component can be added or specifically support the separation process, which can be formed by an approximately parallel displacement of the packaging blank to be separated relative to the magazine stack, provided that the configuration of the magazine allows this. However, since the essential movement component, which also dominates the method sequence when separating the uppermost or edge packaging blank, provides for the deformation and one-sided lifting of this packaging blank, sufficient space is also created on this limiting side of the magazine for such a lateral displacement, whereby this alternative or additional movement component can be given the necessary space.

However, in the case of these two superimposed movement components, which can be added to the deformation of the packaging blank located on the uppermost or at the edge of the magazine stack, care must be taken to ensure that the fixing of the first surface region of the packaging blank gripped in the second surface region is correspondingly adjusted or slightly loosened in order to give the additional movement components the necessary clearance.

After this, the fixing of the first surface region of the packaging blank gripped in the second surface region can be released so that the gripped packaging blank can be separated from the stack, separated from the subsequent packaging blanks, and removed from the magazine as a single packaging blank.

Since the packaging blanks processed using the method described here each have perforations or can be at least partially air-permeable or have a structured surface, and since the packaging blanks are stacked flat against one another in the magazine, they can easily stick together due to adhesion forces when a packaging blank located at the edge or at the top is to be removed. In addition, the air permeability or the perforations can ensure that several packaging blanks are suctioned at the same time, which can pose certain difficulties for separation. In order to remedy these problems, in the method explained here the gripped packaging blank is lifted from the stack in the second surface region and angled towards the fixed first surface region, whereby the packaging blanks underneath are peeled off due to their inherent stress, which can ensure reliable separation of the uppermost packaging blank gripped by the gripping device.

The method can in particular provide that the fixing of the packaging blank situated at the edge of or uppermost on the stack takes place by placing and/or pressing a clamping bracket onto the first surface region. It is preferably further provided that the fixing of the packaging blanks and the gripping of the packaging blank situated at the edge of or uppermost on the stack is carried out by a handling device suitable for this purpose and equipped accordingly.

This handling device can be lifted and lowered and/or fed towards and lifted away from the stack in order to carry out the process steps necessary for carrying out the method. To make this possible, the handling device can, for example, have a gantry suspension with three-axis mobility or another movable suspension.

The method can further provide that the packaging blank situated at the edge of or uppermost on the stack is taken hold of and gripped by a gripping device, wherein this gripping device is arranged on the handling device and/or is pivotally mounted there. The gripping device mentioned can in particular comprise at least one suction plunger or at least one other gripping device operating with suction pressure, wherein it can be provided that the suction plunger(s) can be subjected to variably adjustable negative pressure.

In addition, it is useful for carrying out the method if the gripping device with the at least one suction plunger is angle-adjustably or otherwise movably mounted relative to the clamping apparatus or the clamping bracket, so that the packaging blanks can be deformed and bent in the desired manner.

The method provides that the packaging blank situated at the edge of or uppermost on the stack is deformed by pivoting the gripping device while the clamping apparatus or clamping bracket is simultaneously fixed and is lifted off the stack with the other packaging blanks on at least one side, which normally ensures the desired detachment of the packaging blanks lying underneath so that they are not removed from the magazine together with the uppermost packaging blank when this packaging blank is to be separated.

The method can provide that by deforming and lifting off on one side the packaging blank situated at the edge of or uppermost on the stack, the packaging blank adjoining it is detached or peeled off from the gripped packaging blank, wherein existing adhesion forces between the packaging blanks can be released and the gripped packaging blank can be separated.

If, from the point of view of a person skilled in the art, a useful combination with one another is possible, some or all of these above-mentioned variations or embodiment variants of the method according to the invention and/or of the packaging apparatus according to the invention can optionally also be combined with one another in order to at least partially achieve the above-formulated objective(s), and/or to achieve the desired effect of the invention.

It should be additionally emphasized at this point that all aspects and embodiment variants which have been explained in connection with the packaging apparatus according to the invention can also relate to, or form, partial aspects of the method according to the invention. Therefore, if the description or the claim definitions pertaining to the packaging apparatus according to the invention make mention of certain aspects and/or correlations and/or effects, this applies equally to the method according to the invention. The same applies vice versa, so that all aspects and embodiment variants which have been explained in connection with the method according to the invention can also relate to, or be, partial aspects of the packaging apparatus according to the invention. Therefore, if the description or the claim definitions pertaining to the method according to the invention make mention of certain aspects and/or correlations and/or effects, this applies equally to the packaging apparatus according to the invention.

To achieve the above-mentioned aim, the invention finally proposes a removal apparatus for the individual removal of packaging blanks from a magazine that are stacked on top of one another or arranged with their flat sides joined together, wherein this removal apparatus is equipped with a horizontally and vertically movable handling device with tools arranged thereon. The tools are formed at least by a clamping bracket and by a gripping device, wherein the clamping bracket is provided and configured accordingly for pressing on and fixing the stack of packaging blanks located in the magazine in a first surface region. In addition, the gripping device is provided and configured accordingly for taking hold of a packaging blank located uppermost on the stack in a second surface region adjoining the first surface region.

For the removal apparatus, it is provided that the gripping device is pivotable during or after lifting the uppermost gripped packaging blank in the second surface region from the stack in such a way that the second surface region can be angled towards the first surface region fixed in order to separate the gripped packaging blank from the stack after releasing the clamping bracket and to remove it from the magazine by lifting the handling device.

The removal apparatus can in particular be part of the packaging apparatus explained above in various embodiments. In addition, the removal apparatus can be used to carry out the method described in different variants.

The following explanations again combine some aspects of the invention previously explained in different embodiment variants, clarify some aspects, but should not be considered in conflict with the statements already made, but in conjunction; in case of doubt, possibly as more specific variants and/or modifications. Thus, as already mentioned multiple times above, the removal and separation method according to the invention can be used to remove individual flat packaging blanks from a magazine without the packaging blanks adhering to one another.

If a magazine contains a large number of packaging blanks stacked on top of one another, there is often the problem of reliably separating the individually removed packaging blanks and preventing several packaging blanks from being removed simultaneously. Since in such a stack the packaging blanks lie on top of one another with their flat sides, they often stick together quite strongly when they are to be removed from the magazine from above and lifted off the magazine stack.

The packaging blanks are removed by a handling device located above the magazine, which is used to take hold of the packaging blanks to be removed from the magazine and to transfer them to a destination not further specified here. What is generally referred to here as the destination for the packaging blanks individually removed from the magazine can in particular be part of a processing and/or packaging module in which the packaging blanks are placed on an article grouping or container grouping provided for this purpose, so that these article or container groupings are thus converted in each instance into containers.

The handling device, which is coupled, for example, to a gantry suspension or another suitable suspension, can in this way be movable for example about at least two axes, namely about a vertical axis, whereby the handling device can be lifted and lowered and thus can be fed towards the magazine stack from above or lifted off from it. In addition, the gantry suspension of the handling device requires at least one further axis of movement, which can be oriented in a horizontal direction, for example, in order to be able to move the handling device between the magazine and another destination for applying the packaging blanks individually removed from the magazine. Optionally, a third axis of movement can be added, which can preferably also be in the horizontal direction and can expediently be perpendicular or diagonal to the first horizontal axis of movement, thus providing a gantry suspension movable about three axes for the handling device.

If no such gantry suspension is provided for the handling device, it can also be equipped with a multi-axis robot, a parallel kinematics robot, or similar, which would ensure the desired mobility.

For the purpose of removing individual packaging blanks, the handling device of the removal apparatus, which is movably mounted on the gantry suspension, is initially located at a defined distance above the magazine stack and the magazine, for example due to a previous return movement from a destination or application site at which a packaging blank previously lifted from the stack was transferred to an application unit or applied to an article or container grouping.

In a subsequent process step, the handling device can be lowered in the vertical direction, thereby reducing the vertical distance between the handling device. In addition, a clamping bracket that can be lowered with the handling device or stored there can be lowered onto a first surface region of the uppermost packaging blank on the stack and pressed on there. In this way, the clamping bracket can ensure that the packaging blanks in the stack are all fixed in the first surface region and pressed into the magazine or onto the adjoining packaging blanks in the stack.

For this purpose, the clamping bracket can be attached to a frame or support element of the handling device, for example by a rigid or telescopic connecting rod, and in the case of telescoping, can be configured to be capable of being separately lowered or lifted relative to the frame or support element.

Simultaneously with the clamping bracket being lowered onto the first surface region of the stack of packaging blanks and preferably pressed on there, a gripping device can be lowered onto a second surface region of the uppermost packaging blank, adjoining the first surface region, in order to be able to grip it and pick it up by the gripping device.

Optionally, the gripping device can comprise two, three or more suction plungers arranged next to one another, which can typically be arranged next to one another in a row. The suction plungers can in particular be vacuum-controlled grippers which can be supplied via supply lines with the negative pressure required to pick up the packaging blank in the second surface region. Alternatively, it can be expedient to apply a variable, adjustable negative pressure to the suction plungers via the supply lines.

After the handling device has been lowered vertically downwards, the clamping bracket contacts the first surface region of the uppermost packaging blank and presses this packaging blank from above onto the packaging blanks of the magazine stack situated thereunder, while the at least two suction plungers, which form the gripping device, contact the uppermost packaging blank in the second surface region in order to be able to pick it up afterwards.

In a subsequent process phase, the suction plungers are each subjected to a negative pressure via the supply lines, after which the packaging blank suctioned in this way can be lifted from the stack in the second surface region. Since the gripping device is slightly angled at the same time, the uppermost packaging blank gripped by the suction plunger is also angled in its second surface region towards the first surface region fixed by the clamping bracket.

Since the stacked packaging blanks may have perforations or be air-permeable depending on their intended use and their specific configuration, conventional handling devices with suction plungers, which are lowered vertically from above onto the magazine stack with the packaging blanks, are often not able to reliably separate the uppermost packaging blank from the packaging blanks below and pick it up as an individual packaging blank in order to supply it for further processing. Such packaging blanks that are permeable to air, have perforations, or are otherwise equipped with structured surfaces instead require the process phases to be modified in the manner described.

This is done by supporting the packaging blanks using the clamping bracket, suctioning the uppermost packaging blank on top using the suction plungers and rotating the suction plungers around the pivot axis in a defined pivot direction. In this way, the packaging blanks that are stacked flat against one another in the magazine and adhere to one another by adhesion can be reliably separated.

Due to the rotation of the suction plungers, while the suction plungers are simultaneously slightly lifted and the support is maintained by the clamping bracket, the subsequent packaging blank detaches from the upper packaging blank that has been suctioned and remains on the magazine stack, while the uppermost packaging blank can be lifted off in the desired manner.

Normally, the subsequent packaging blank is first pulled along in the second surface region and lifted off from the further packaging blank underneath. However, the subsequent packaging blank, which is initially pulled along with the uppermost packaging blank due to the adhesive force effect, detaches from the suctioned packaging blank when the suction plunger is pivoted further about the pivot axis in a defined pivot direction and finally falls back onto the magazine stack when the packaging blank located above is lifted off the stack by lifting the handling device and is removed from the magazine.

The gripping device, which is angle-adjustable relative to the clamping bracket, pivots when the clamping bracket is fixed in place to ensure targeted deformation of at least the suctioned uppermost packaging blank, which can also be lifted off the magazine stack on one side by the negative pressure applied to the suction plungers. At the same time, the adjoining packaging blank underneath is detached from the gripped packaging blank, so that the adhesion forces prevailing between these flat packaging blanks can be overcome and the gripped packaging blank can be separated.

In this process phase, the clamping fixing of the first surface region of the packaging blank gripped by the suction plungers in the second surface region, as well as of all packaging blanks of the magazine stack located underneath, is released, so that the gripped packaging blank can be separated from the stack as an individual packaging blank and thus removed from the magazine.

Optionally, the telescopic connecting rod can be shortened as required so that it can be lifted off from the suctioned packaging blank as soon as the handling device moves away from the magazine in a horizontal movement. The negative pressure applied to the suction plungers must be maintained because the packaging blank is to be transported to a destination that is located away from the magazine.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

DETAILED DESCRIPTION OF THE INVENTION

Identical reference signs are used for identical elements of the invention or those having the same effect. Furthermore, for the sake of clarity, only reference signs are shown in the individual figures, which are required for the description of the respective figure. The illustrated embodiments are merely examples of how the apparatus according to the invention or the method according to the invention can be configured, and they are non-limiting.

The schematic side views of FIG. 1A to 1D and FIGS. 2A and 2B show, when viewed together, successive process steps in the implementation of a variant of the removal and separation method according to the invention, in which individual flat packaging blanks 10 are removed from a magazine 12 in which several such packaging blanks 10 are stacked on top of one another.

As can be seen from FIG. 1A to 1D and FIGS. 2A and 2B, a plurality of packaging blanks 10 stacked on top of one another are located in the magazine 12, so that the plurality of stacked packaging blanks 10 located there can be referred to as a magazine stack 14 or simply as a stack 14. In the stack 14, the packaging blanks 10 lie against one another with their flat sides, wherein the flat sides each have a horizontal orientation, so that the packaging blanks 10 can be removed one after the other from above from the magazine 12 and lifted off the magazine stack 14.

The precise shape of the container of the trough-shaped magazine 12, which is open at the top, is not to be specified in more detail at this point, since the present context is about the property of the magazine 12 that is essential for the method, namely its accessibility from above in order to be able to remove an uppermost packaging blank 10-1 and to separate it from subsequent packaging blanks 10-2 and/or 10-3, which become accessible for removal after the uppermost packaging blank 10-1 has been removed.

Since the attached FIG. 1A to 3B each show a trough-shaped magazine 12 which is open at the top and in which the packaging blanks 10 are stacked on top of one another in a horizontal orientation, it should be noted at this point, purely as a precaution, that this is by no means intended to imply that the invention and the inventive removal and separation method are to be limited to such an arrangement. For a person skilled in the art, it is immediately apparent from the context of the present embodiments that differently configured magazines 12 with other directions of removal also implement the same inventive ideas and thus fall under the definitions of the present invention. These can be, for example, magazine configurations with vertically standing or inclined packaging blanks 10, which can thus be removed in a horizontal or inclined direction from a magazine 12 configured in this way.

Figure 1A:
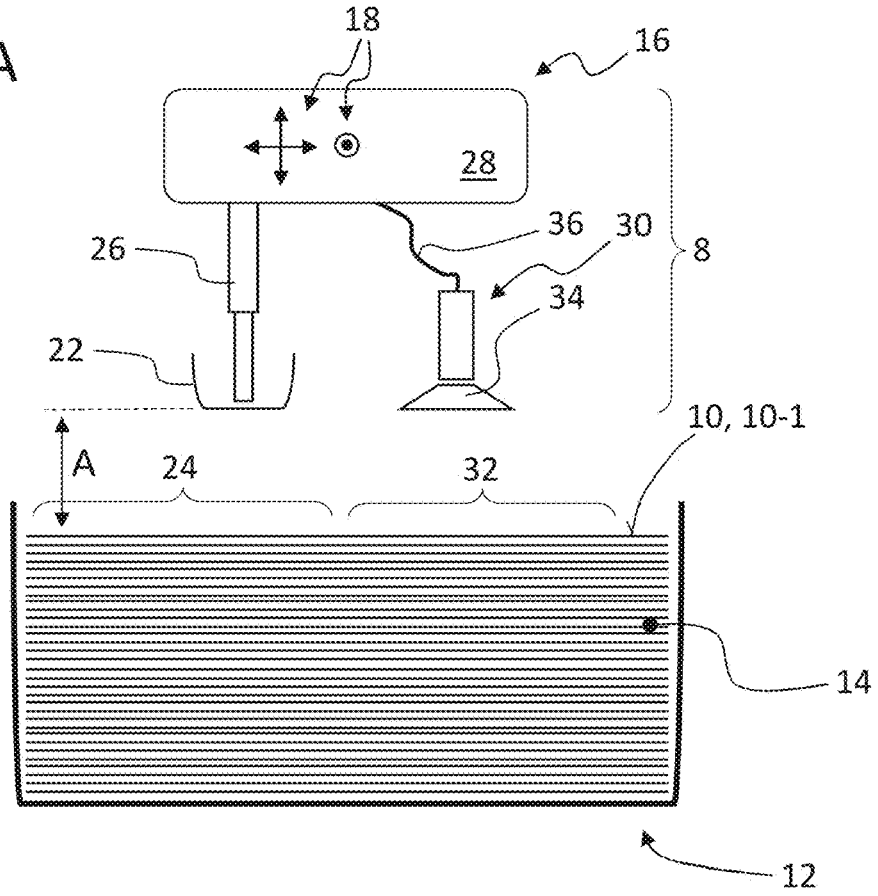
FIG. 1A to 1D show, in schematic side views, successive process steps in the removal and separation of packaging blanks from a magazine, wherein the process steps illustrate parts of a variant embodiment of a method according to the invention using a variant embodiment of a removal apparatus according to the invention.

The subsequent packaging blank 10-2 located below the packaging blank 10-1 uppermost in the magazine stack 14 is designated in more detail in FIGS. 1C and 1D with this reference number 10-2. The additional packaging blank 10-3 located underneath is also illustrated in FIGS. 1C and 1D and is marked there with the corresponding reference number 10-3. The order of the uppermost packaging blank 10-1, the subsequent packaging blank 10-2 underneath it, and the further packaging blank 10-3 underneath it also corresponds to the removal order in the magazine stack 14 from top to bottom.

As can be further seen from FIG. 1A to 2B, a handling device 16 is located above the magazine 12 with the stack 14 of the packaging blanks 10 stacked on top of one another, which serves to take hold of the packaging blanks 10 to be removed from the magazine 12 and to transfer them to a destination not shown in more detail here. What is generally referred to here as the destination for the packaging blanks 10 individually removed from the magazine 12 can in particular be part of a processing and/or packaging module (not shown) in which the packaging blanks 10 are placed on an article grouping or container grouping provided for this purpose, so that these article or container groupings are thus converted in each instance into containers.

The handling device 16, which is coupled, for example, to a gantry suspension 18 or another suitable suspension, can in this way be movable for example about at least two axes, namely about a vertical axis, whereby the handling device 16 can be lifted and lowered and thus can be fed towards the magazine stack 14 from above or lifted off from it. In addition, the gantry suspension 18 of the handling device 16 requires at least one further movement axis, which can be oriented, for example, in a horizontal direction, in order to be able to move the handling device 16 between the magazine 12 and a further destination for the application of the packaging blanks 10 individually removed from the magazine 12. Optionally, a third axis of movement can be added, which can preferably also be in the horizontal direction and can expediently be perpendicular or diagonal to the first horizontal axis of movement, thus providing a gantry suspension 18 movable about three axes for the handling device 16.

If no such gantry suspension 18 is provided for the handling device 16, it can also be equipped with a multi-axis robot, a parallel kinematics robot, or similar, which would ensure the desired mobility.

By examining FIGS. 1A to 1D and 2A and 2B, the process, which takes place in several successive phases, can be understood by which individual packaging blanks 10 are lifted one after the other from the magazine stack 14 and removed from the magazine 12. Since the handling device 16 together with its handling elements 22, 30, etc. described in more detail below serves to remove individual packaging blanks 10 from the magazine 12, the entire arrangement will also be referred to below as removal apparatus 8.

The handling device 16 of the removal apparatus 8, which is movably mounted on the gantry suspension 18, is initially located at a certain distance A above the magazine stack 14 and the magazine 12 (cf. FIG. 1A), for example due to a previous return movement from a destination or application site at which a packaging blank (not shown here) previously lifted from the stack 14 was transferred to an application unit or applied to an article or container grouping.

Figure 1B:
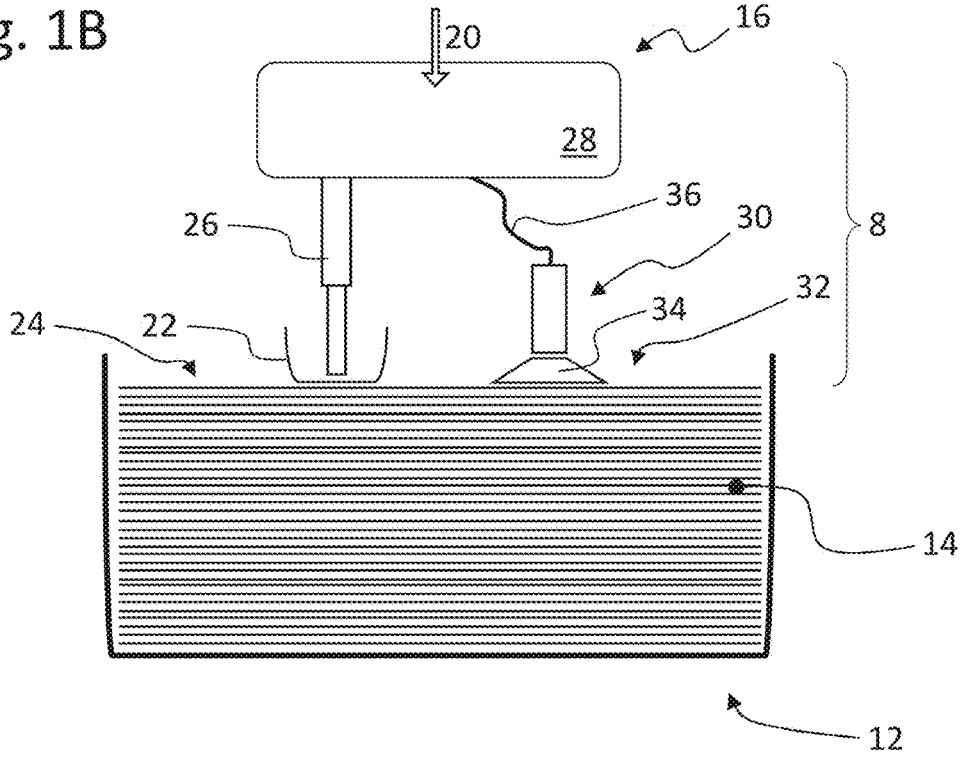
Figure 1C:
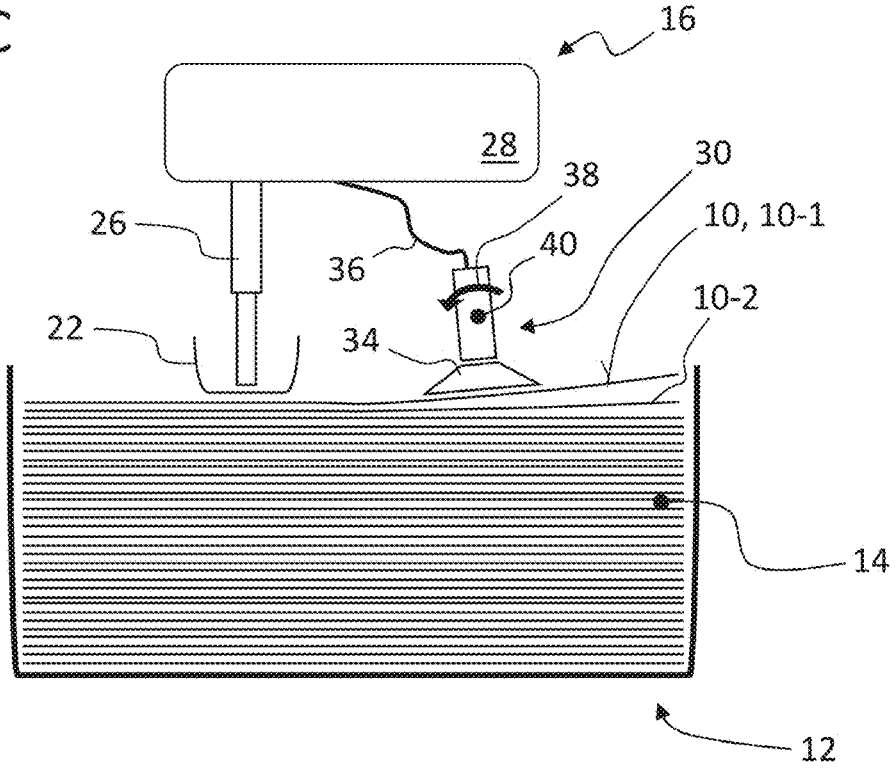
Figure 1D:
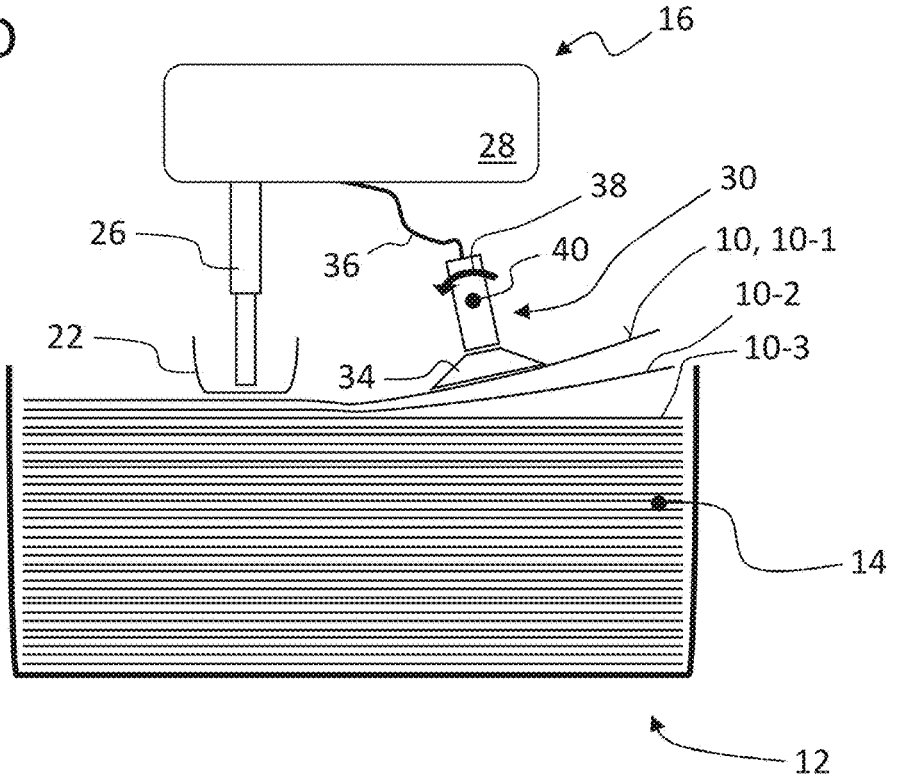

The schematic side view of FIG. 1B shows how, in the next process step, the handling device 16 is lowered in the vertical direction, as illustrated by the directional arrow 20, which indicates the lowering movement of the handling device. The vertical distance A between the handling device 16, which is still present in FIG. 1A, is therefore no longer present, since a clamping bracket 22 that can be lowered with the handling device 16 or mounted there is lowered onto a first surface region 24 of the uppermost packaging blank 10-1 lying on top of the stack 14 and is pressed on there. In this way, the clamping bracket 22 ensures that the packaging blanks 10 of the stack 14 are all fixed in the first surface region 24 and pressed into the magazine 12 or onto the adjoining packaging blanks 10 of the stack 14.

For this purpose, the clamping bracket 22 can be attached to a frame or support element 28 of the handling device 16 by a rigid or telescopic connecting rod 26, and in the case of telescoping capabilities, can be configured to be capable of being separately lowered or lifted relative to the frame or support element 28.

Simultaneously with the clamping bracket 22 being lowered onto the first surface region 24 and preferably pressed on there, a gripping device 30 is lowered onto a second surface region 32 of the uppermost packaging blank 10-1, adjoining the first surface region 24, in order to be able to grip it and pick it up by the gripping device 30.

In the embodiment shown, the gripping device 30 comprises two, three or more suction plungers 34 arranged next to one another, which are typically arranged next to one another in a row, wherein this row is preferably aligned perpendicular to the plane of the drawing, so that only one of the suction plungers 34 is visible in each instance. The fact that the suction plungers 34 are vacuum-controlled grippers is illustrated by an indicated supply line 36 via which the suction plungers 34 can be supplied with the negative pressure required to pick up the packaging blank 10 in the second surface region 32. Alternatively, it can be expedient to apply a variably adjustable negative pressure to the suction plungers 34 via the supply lines 36.

After the handling device 16 has been lowered downward in the vertical direction 20, the clamping bracket 22 contacts the first surface region 24 of the uppermost packaging blank 10-1 and presses this packaging blank 10-1 from above onto the packaging blanks 10 of the magazine stack 14 situated thereunder, while the at least two suction plungers 34, which form the gripping device 30, contact the uppermost packaging blank 10-1 in the second surface region 32, which is shown in the schematic side view of FIG. 1B.

The schematic side view of FIG. 1C illustrates a subsequent process phase in which the suction plungers 34 are subjected to a negative pressure via the supply line 36, after which the packaging blank 10-1 suctioned in this way can be lifted from the stack 14 in the second surface region 32. Since the gripping device 30 is slightly angled at the same time, the uppermost packaging blank 10-1 gripped by the suction plunger 34 is also angled in its second surface region 32 towards the first surface region 24 fixed by the clamping bracket 22.

As FIGS. 1C and 1D illustrate, the suction plungers 34 are pivoted 38 about a pivot axis 40, wherein the pivot direction 38 in the illustration takes place with a rotation to the left about the pivot axis 40, which leads to the shown one-sided lifting of the packaging blank 10-1 in its second surface region 32.

Since the stacked packaging blanks 10 may have perforations or be air-permeable depending on their intended use and their specific configuration, handling devices 16 with suction plungers 34, which are lowered vertically from above onto the magazine stack 14 with the packaging blanks 10, are often not able to reliably separate the uppermost packaging blank 10-1 from the packaging blanks below and pick it up as an individual packaging blank 10-1 in order to supply it for further processing. Such packaging blanks 10 that are permeable to air, have perforations, or are otherwise equipped with structured surfaces instead require the process phases to be modified in the manner described and illustrated in FIG. 1A to 2B.

Figure 2A:
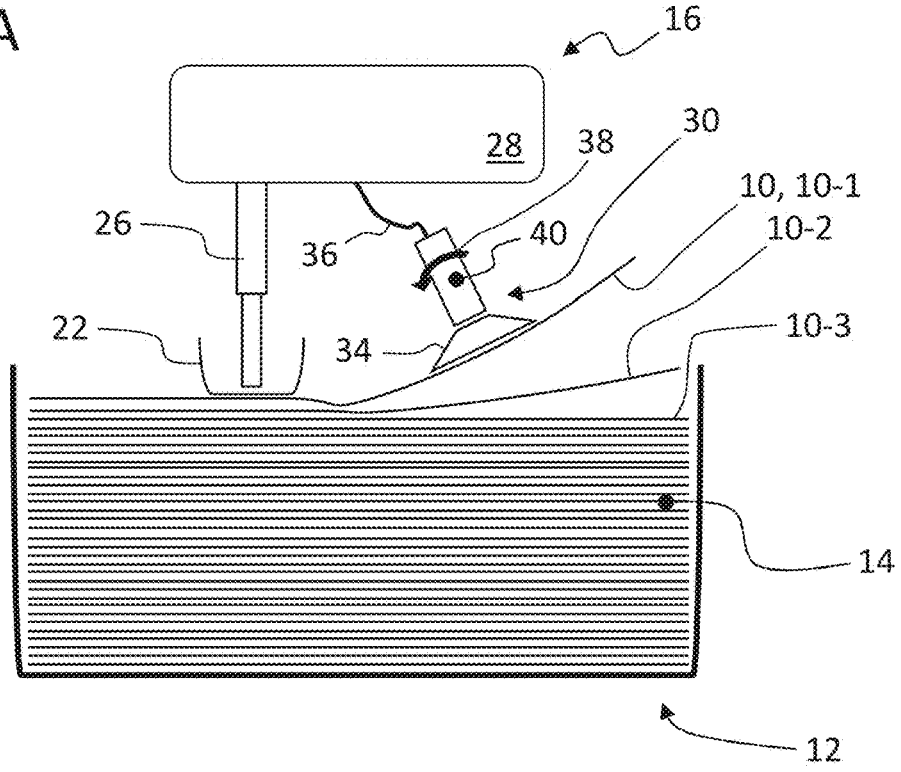
FIGS. 2A and 2B show further process steps in schematic side views, which can follow the process steps according to FIG. 1A to 1D.

This is done by supporting the packaging blanks 10 using the clamping bracket 22, suctioning the uppermost packaging blank 10-1 using the suction plungers 34 and rotating the suction plungers 34 about the pivot axis 40 in the pivot direction 38 to the left, as shown in FIGS. 1C, 1D, and 2A. In this way, the packaging blanks 10 that are stacked flat against one another in the magazine 12 and adhere to one another by adhesion can be reliably separated.

As FIGS. 1C and 1D illustrate, due to the rotation of the suction plungers 34, while the suction plungers 34 are simultaneously slightly lifted and the support is maintained by the clamping bracket 22, the subsequent packaging blank 10-2 detaches from the upper packaging blank 10-1 that has been suctioned and remains on the magazine stack 14, while the uppermost packaging blank 10-1 can be lifted off in the desired manner.

Normally, the subsequent packaging blank 10-2 is first pulled along in the second surface region 32 and lifted off from the further packaging blank 10-3 underneath. However, the subsequent packaging blank 10-2, which is initially pulled along with the uppermost packaging blank 10-1 due to the adhesive force effect, detaches from the suctioned packaging blank 10-1 when the suction plunger 34 is pivoted further about the pivot axis 40 in the pivot direction 38 to the left (cf. FIG. 2A), and finally falls back onto the magazine stack when the packaging blank 10-1 located above it is lifted off the stack 14 by lifting the handling device 16 and is removed from the magazine 12 (cf. FIG. 2B).

The gripping device 30, which is angle-adjustable relative to the clamping bracket 22, pivots when the clamping bracket 22 is fixed in place to ensure targeted deformation of at least the suctioned uppermost packaging blank 10-1, which can also be lifted off the magazine stack 14 on one side by the negative pressure applied to the suction plungers 34. At the same time, the adjoining packaging blank 10-2 underneath is detached from the gripped packaging blank 10-1, so that the adhesion forces prevailing between these flat packaging blanks 10-1 and 10-2 can be overcome and the gripped packaging blank 10-1 can be separated.

Figure 2B:
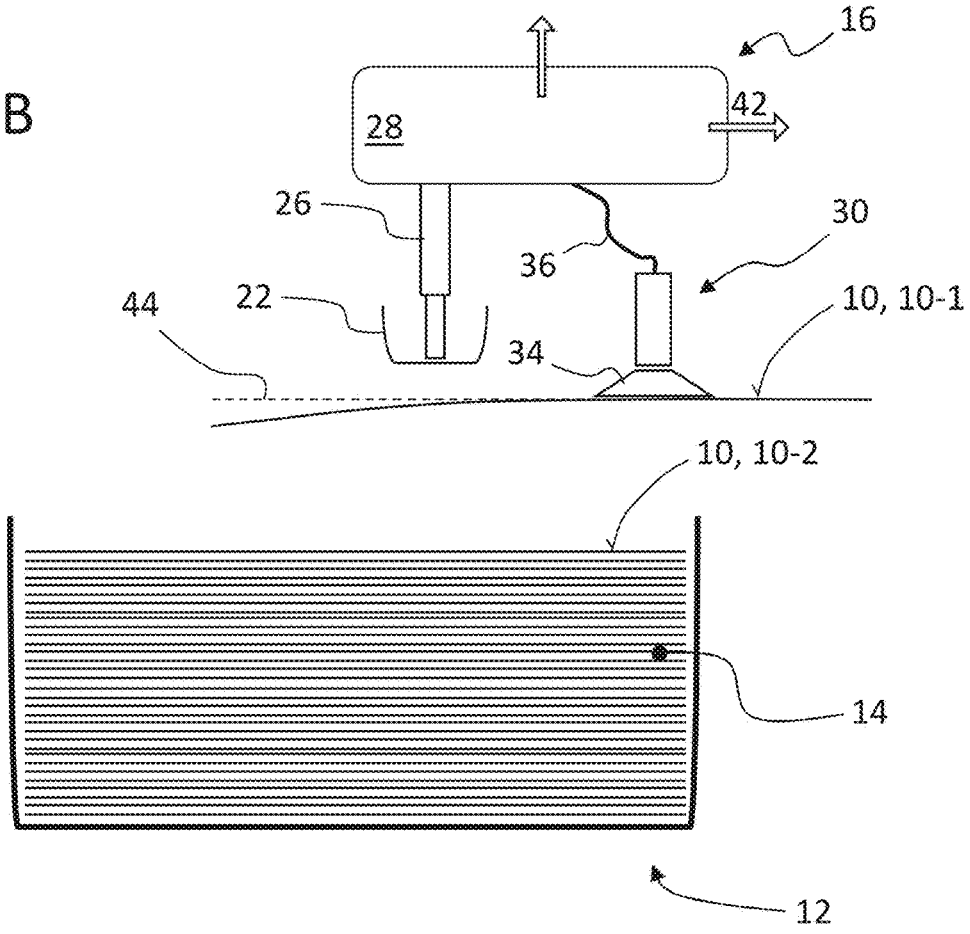

In this process phase, which is shown in FIG. 2B, the clamping fixing of the first surface region 24 of the packaging blank 10-1 gripped by the suction plungers 34 in the second surface region, as well as of all packaging blanks 10 of the magazine stack 14 located underneath, is released, so that the gripped packaging blank 10-1 can be separated from the stack 14 as an individual packaging blank 10 and thus removed from the magazine 12.

FIG. 2B also shows an optional shortening of the telescopic connecting rod 26, which can thus be lifted off the suctioned packaging blank 10-1 when the handling device moves away from the magazine 12 in a horizontal movement 42. The negative pressure applied to the suction plungers 34 must be maintained because the packaging blank 10-1 is to be transported to a destination that is located away from the magazine 12.

Under certain circumstances, the packaging blank 10-1 can deform in its first surface region 24 under its own weight, which is indicated by the left region sagging below the lifted clamping bracket 22. The horizontal alignment 44 of the packaging blank 10-1, which it had in the magazine stack 14, is indicated in FIG. 2B by a broken line.

Figure 3A:
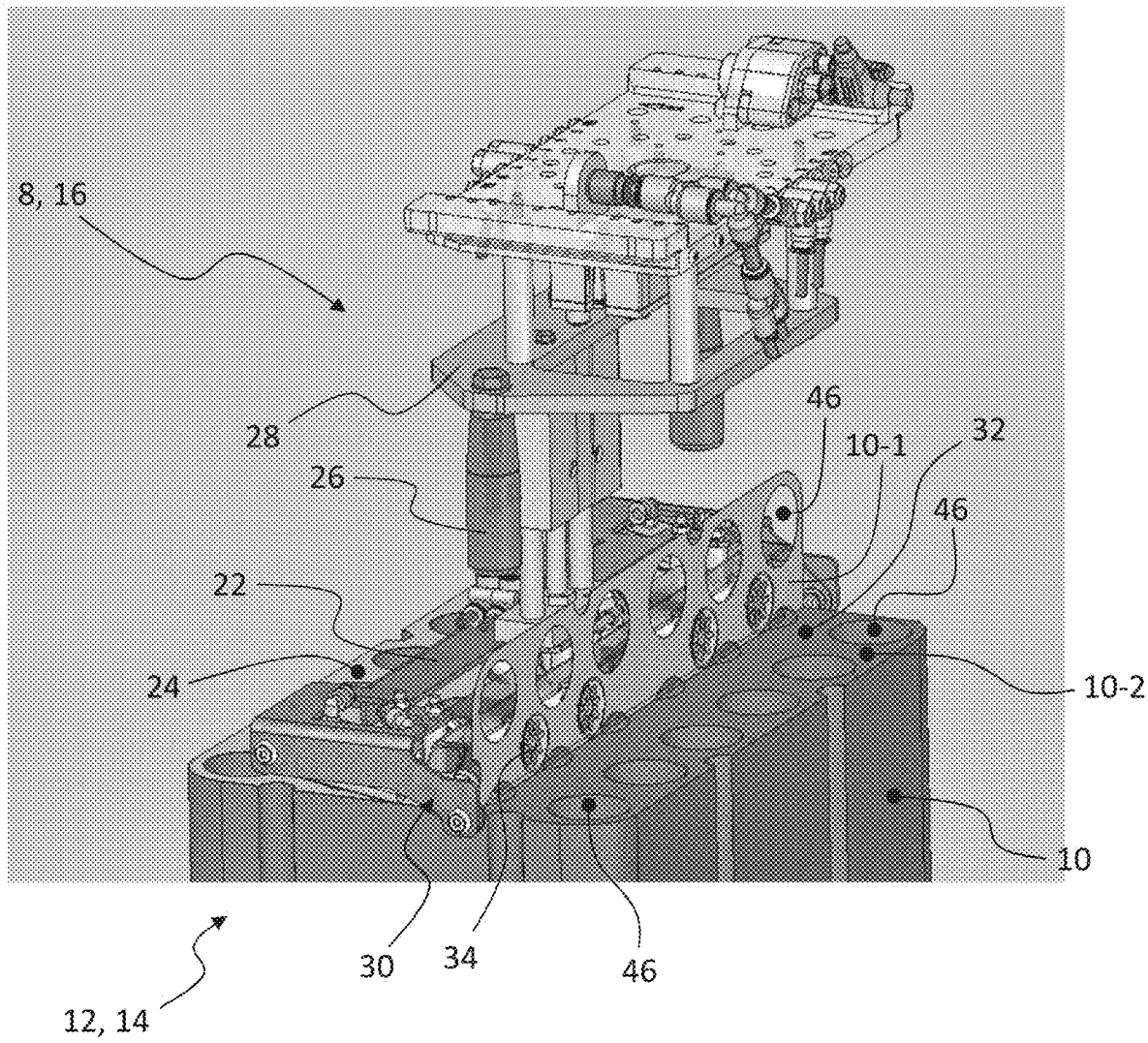
FIGS. 3A and 3B show, in schematic and perspective views, a variant embodiment of a removal apparatus for the individual removal of packaging blanks from a magazine.
Figure 3B:
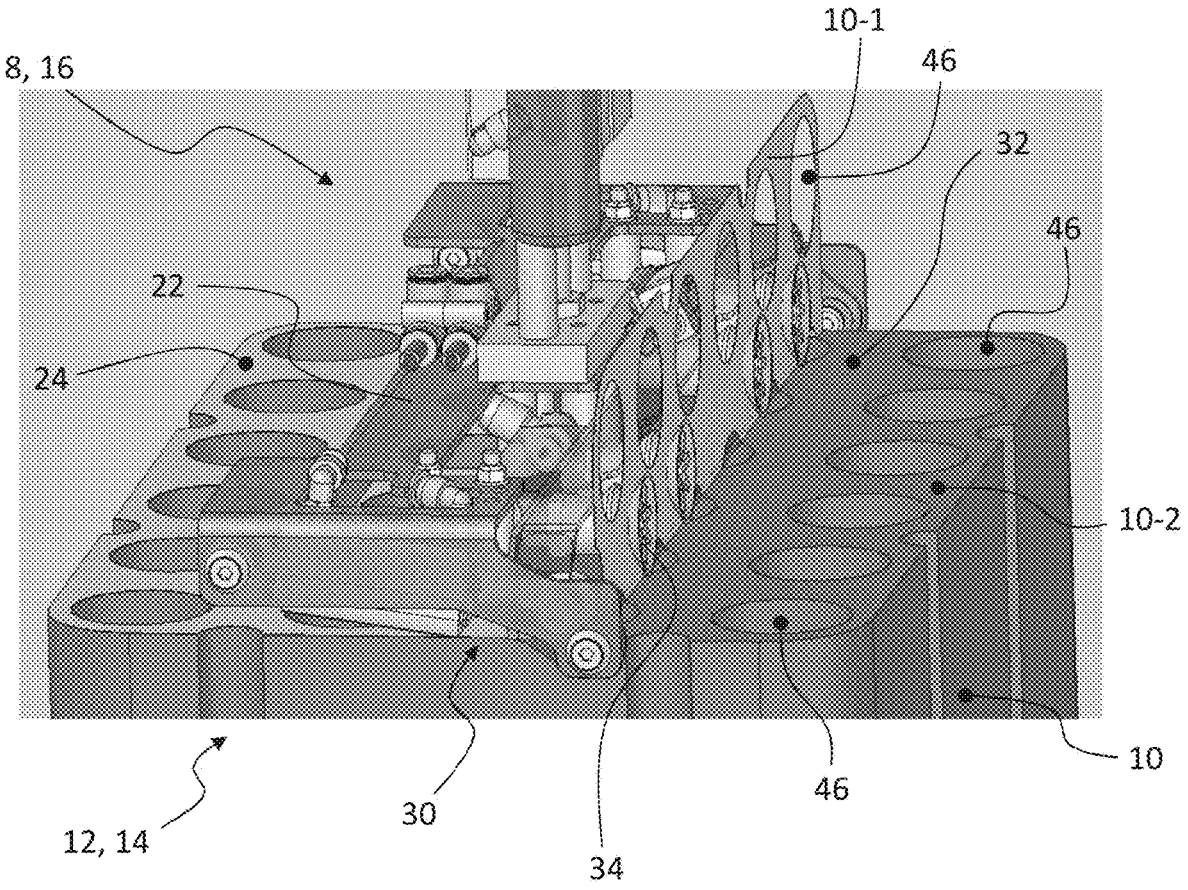

The perspective representations of FIGS. 3A and 3B illustrate a specific configuration option of the handling device 16 and its interaction with a magazine stack 14 of several packaging blanks 10 stacked on top of one another within a magazine 12.

As can be seen from the perspective view of FIG. 3A and the perspective detail view of FIG. 3B, a plurality of packaging blanks 10 stacked on top of one another are located in the magazine 12, so that the plurality of stacked packaging blanks 10 located there can be referred to as a magazine stack 14 or simply as a stack 14. In the stack 14, the packaging blanks 10 lie against one another with their flat sides, wherein the flat sides each have a horizontal orientation, so that the packaging blanks 10 can be removed one after the other from above from the magazine 12 and lifted off the magazine stack 14.

As can be seen from FIGS. 3A and 3B, the packaging blanks 10 each have a large number of circular perforations 46, which can lead to the difficulties explained above when suctioning the packaging blanks 10.

Above the magazine 12 with the stack 14 of the packaging blanks 10 stacked on top of one another therein is the handling device 16, which serves to take hold of the packaging blanks 10 to be removed from the magazine 12 and to transfer them to a destination not shown in more detail here. This destination for the packaging blanks 10 individually removed from the magazine 12 can in particular be part of a processing and/or packaging module (not shown) in which the packaging blanks 10 are placed on an article grouping or container grouping provided for this purpose, so that these article or container groupings are thus converted into containers.

The handling device 16, which is coupled, for example, to a gantry suspension or another suitable suspension, can in this way be movable for example about at least two axes, namely about a vertical axis, whereby the handling device 16 can be lifted and lowered and thus can be fed towards the magazine stack 14 from above or lifted off from it. In addition, the handling device 16 is movable along a further movement axis, which can be oriented, for example, in a horizontal direction, in order to be able to move the handling device 16 between the magazine 12 and a further destination for the application of the packaging blanks 10 individually removed from the magazine 12.

In FIG. 3A and FIG. 3B, the handling device 16 has already been lowered in the vertical direction. In addition, the clamping bracket 22 is located on the stack 14 and presses on the first surface region 24 of the uppermost packaging blank 10 of the stack 14. In this way, the clamping bracket 22 ensures that the packaging blanks 10 of the stack 14 are all fixed in the first surface region 24 and pressed into the magazine 12 or onto the adjoining packaging blanks 10 of the stack 14.

For this purpose, the clamping bracket 22 can be attached to a frame or support element 28 of the handling device 16 by a rigid or telescopic connecting rod 26, and in the case of telescoping capabilities, can be configured to be capable of being separately lowered or lifted relative to the frame or support element 28.

The gripping device 30 with its several suction plungers 34 is already activated and has folded over the uppermost packaging blank 10-1. In the embodiment shown in FIGS. 3A and 3B, the gripping device 30 comprises four suction plungers 34 arranged next to one another in a row. Not shown are supply lines which are routed to line connections in the region of the frame or support element 28, with which the suction plungers 34 can be supplied with the negative pressure required to pick up the packaging blank 10 in the second surface region 32.

The packaging blank 10-1 suctioned in with the suction plungers 34 is lifted from the stack 14 in the second surface region 32 and folded upwards by approximately 90°. For this purpose, the gripping device 30 can be angled while the clamping bracket 22 remains in its position. The pivoting about the pivot axis 40 has already been illustrated and explained on the basis of FIGS. 1C and 1D. Due to the shown pivoting of the suction plungers 34, the subsequent packaging blank 10-2 detaches from the upper packaging blank 10-1 that has been suctioned and remains on the magazine stack 14, while the uppermost packaging blank 10-1 can be lifted off in the desired manner.

The gripping device 30, which is angle-adjustable relative to the clamping bracket 22, pivots when the clamping bracket 22 is fixed in place to ensure targeted deformation of at least the suctioned uppermost packaging blank 10-1, which can also be lifted off the magazine stack 14 on one side by the negative pressure applied to the suction plungers 34. At the same time, the adjoining packaging blank 10-2 underneath is detached from the gripped packaging blank 10-1, so that the adhesion forces prevailing between these flat packaging blanks 10-1 and 10-2 can be overcome and the gripped packaging blank 10-1 can be separated.

In a process phase not shown here, the clamping fixing of the first surface region 24 of the packaging blank 10-1 gripped by the suction plungers 34 in the second surface region, as well as of all packaging blanks 10 of the magazine stack 14 located underneath, is released (cf. FIG. 2B), so that the gripped packaging blank 10-1 can be separated from the stack 14 as an individual packaging blank 10 and thus removed from the magazine 12.

The following is given as a supplementary note to the above statements. If, in the context of the embodiment variants shown in FIG. 1A to 3B and their descriptions above, reference is also made often or also generally to "schematic" representations and views, this means by no means that the figure representations and their description are to be of subordinate importance with regard to the disclosure of the invention. A person skilled in the art is certainly able to derive sufficient information from the schematically and abstractly drawn representations that will make it easier for a person skilled in the art to understand the invention without being confused in any way by the drawn and possibly not exactly true-to-scale proportions of parts of the removal apparatus 8, the handling device 16, or other details thereof or other drawn elements of the apparatuses described herein. Rather, the figures allow a person skilled in the art, as the reader, to derive a better understanding of the inventive idea—which has been formulated in more general and/or more abstract terms in the claims and in the general part of the description, at least with regard to some aspects—on the basis of the more specifically explained implementations of the method according to the invention and the explained structure of the apparatus and apparatus parts according to the invention.

This also applies to the open-topped magazine variant of the magazine 12 already explained above, in which the packaging blanks 10 are stacked on top of one another over the other in a horizontal orientation. As already explained, a person skilled in the art will also recognize differently configured magazines 12 with different removal directions as belonging to the invention. The invention may also include alternative magazine configurations with vertically standing or inclined packaging blanks 10, which can thus be removed in a horizontal or inclined direction from a magazine 12 configured in this way.

The following is given as a supplementary note to the above statements. If, in the context of the embodiment variants shown in FIG. 1A to 3B and their descriptions above, reference is also made often or also generally to "schematic" representations and views, this means by no means that the figure representations and their description are to be of subordinate importance with regard to the disclosure of the invention. A person skilled in the art is certainly able to derive sufficient information from the schematically and abstractly drawn representations that will make it easier for a person skilled in the art to understand the invention without being confused in any way by the drawn and possibly not exactly true-to-scale proportions of parts of the removal apparatus 8, the handling device 16, or other details thereof or other drawn elements of the apparatuses described herein. Rather, the figures allow a person skilled in the art, as the reader, to derive a better understanding of the inventive idea—which has been formulated in more general and/or more abstract terms in the claims and in the general part of the description, at least with regard to some aspects—on the basis of the more specifically explained implementations of the method according to the invention and the explained structure of the apparatus and apparatus parts according to the invention.

The invention has been described with reference to a preferred embodiment. However, it is conceivable for a person skilled in the art that modifications or changes can be made to the invention without departing from the scope of protection of the following claims.

LIST OF REFERENCE SIGNS

8 removal apparatus
10 packaging blank
10-1 first packaging blank, uppermost packaging blank
10-2 packaging blank, subsequent packaging blank
10-3 packaging blank, further packaging blank
12 magazine
14 stack, magazine stack
16 handling device
18 gantry suspension
20 lowering movement
22 clamping bracket
24 first surface region
26 connecting rod
28 frame element, support element
30 gripping device
32 second surface region
34 suction punch
36 supply line
38 pivot direction
40 pivot axis
42 horizontal movement
44 horizontal alignment
46 perforation, recess
A vertical distance

The invention claimed is:

1. A packaging apparatus for combining a plurality of articles by an outer packaging formed from a packaging blank, comprising:

a magazine (12) with several flat packaging blanks (10) stacked on top of one another, wherein the packaging blanks (10) are arranged in the magazine (12) stacked on top of one another or with their flat sides joined together, a removal apparatus (8) for the individual removal of packaging blanks (10) from the magazine (12), which removal apparatus (8) is equipped with a horizontally and vertically movable handling device (16) with tools arranged thereon, wherein the tools include at least a clamping bracket (22) and a gripping device (30), wherein the clamping bracket (22) is capable of pressing on and fixing the stack (14) of packaging blanks (10), in a first surface region (24), wherein the gripping device (30) is capable of taking hold of a packaging blank (10, 10-1) that is uppermost in the stack (14) or situated at the edge of the stack (14), in a second surface region (32) adjoining the first surface region (24), wherein the gripping device (30) is mounted pivotably on the handling device (16), wherein the gripping device (30) comprises at least one suction plunger (34) or at least one other gripper operating with suction pressure, wherein the suction plunger or plungers (34) can be subjected to variably adjustable negative pressure, wherein the gripping device (30) with the at least one suction plunger (34) is angle-adjustably or otherwise movably mounted relative to the clamping bracket (22), and wherein the gripping device (30) can be pivoted during lifting or after lifting of the uppermost gripped packaging blank (10, 10-1) from the stack (14) such that the second surface region (32) can be angled towards the fixed first surface region (24) to separate the gripped packaging blank (10, 10-1) from the stack (14) after releasing the clamping bracket (22), and to remove it from the magazine (12) by lifting the handling device (16).

2. The packaging apparatus of claim 1, wherein the clamping bracket (22) is placed or pressed onto the first surface region (24) of the packaging blank (10, 10-1) by an infeed movement of the handling device (16).

3. The packaging apparatus of claim 2, wherein the handling device (16) has a gantry suspension (18) or another movable suspension and can thus be lifted and lowered or fed towards the stack (14) and lifted away from the stack (14).

4. A method for removing individual flat packaging blanks (10, 10-1, 10-2, 10-3) from a magazine (12) with several stacked packaging blanks (10), comprising:

fixing, in a first surface region (24) of a packaging blank (10, 10-1) and pressing into the magazine (12), the packaging blank (10, 10-1) situated at the edge of or uppermost on the stack (14) by placing or pressing a clamping bracket (22) on the first surface region (24), and gripping by a gripping device (30) in a second surface region (32) adjoining the first surface region (24), wherein the gripping device (30) is mounted or pivotably mounted on a handling device (16) and comprises at least one suction plunger (34) or at least one other gripper operating with suction pressure, and wherein the gripping device (30) with the at least one suction plunger (34) is angle-adjustably or otherwise movably mounted relative to the clamping bracket (22), lifting the gripped packaging blank (10, 10-1) from the stack (14) in the second surface region (32) and angled towards the fixed first surface region (24), releasing the first surface region (24) of the packaging blank (10, 10-1), and then separating the gripped packaging blank (10, 10-1) from the stack (14) and removing it from the magazine (12).

5. The method of claim 4, further comprising carrying out the fixing step and the gripping with a handling device (16), wherein the handling device (16) is capable of being lifted and lowered or is capable of being fed towards the stack (14) and lifted away from the stack (14).

6. The method of claim 5, wherein the handling device (16) comprises a gantry suspension (18) or another movable suspension.

7. The method of claim 4, further comprising subjecting the suction plunger or plungers (34) of the gripping device (30) to a variably adjustable negative pressure.

8. The method of claim 4, further comprising deforming the packaging blank (10, 10-1) by pivoting the gripping device (30) with the clamping device or clamping bracket (22) fixed, and lifting off at least on one side of the packaging blank (10, 10-1) from the stack (14).

9. The method according to claim 8, wherein the deforming step comprises detaching or peeling off the gripped packaging blank (10, 10-1) from the adjoining packaging blank (10, 10-2).

10. A removal apparatus (8) for the individual removal of packaging blanks (10) from a magazine (12) comprising a horizontally and vertically movable handling device (16) with tools arranged thereon, wherein the tools include at least a clamping bracket (22) and a gripping device (30), wherein the clamping bracket (22) is capable of pressing on and fixing the stack (14) of packaging blanks (10), in a first surface region (24), wherein the gripping device (30) is capable of taking hold of a packaging blank (10, 10-1) that is uppermost in the stack (14), in a second surface region (32) adjoining the first surface region (24), and wherein the gripping device (30) can be pivoted during lifting or after lifting of the uppermost gripped packaging blank (10, 10-1) in the second surface region (32) from the stack (14) such that the second surface region (32) can be angled towards the fixed first surface region (24) to separate the gripped packaging blank (10, 10-1) from the stack (14) after releasing the clamping bracket (22), and to remove it from the magazine (12) by lifting the handling device (16).

* * * * *